US011355272B2

(12) United States Patent
Chang et al.

(10) Patent No.: US 11,355,272 B2
(45) Date of Patent: Jun. 7, 2022

(54) STRUCTURE OF AN ELECTRONIC COMPONENT AND AN INDUCTOR

(71) Applicant: CYNTEC CO., LTD., Hsinchu (TW)

(72) Inventors: Yung-Cheng Chang, Hsinchu County (TW); Chih-Siang Chuang, Hsinchu (TW); Yi-Min Huang, Hsinchu (TW)

(73) Assignee: CYNTEC CO., LTD, Hsinchu (TW)

( * ) Notice: Subject to any disclaimer, the term of this patent is extended or adjusted under 35 U.S.C. 154(b) by 775 days.

(21) Appl. No.: 15/865,287

(22) Filed: Jan. 9, 2018

(65) Prior Publication Data

US 2018/0130584 A1 May 10, 2018

Related U.S. Application Data

(63) Continuation of application No. 14/867,019, filed on Sep. 28, 2015, now Pat. No. 9,899,131.

(60) Provisional application No. 62/194,308, filed on Jul. 20, 2015.

(51) Int. Cl.

| | |
|---|---|
| ***H01F 27/02*** | (2006.01) |
| ***H01F 5/04*** | (2006.01) |
| ***H01F 3/10*** | (2006.01) |
| ***H01F 17/04*** | (2006.01) |
| ***H01F 27/29*** | (2006.01) |

(52) U.S. Cl.

CPC ..... *H01F 5/04* (2013.01); *H01F 3/10* (2013.01); *H01F 17/04* (2013.01); *H01F 27/292* (2013.01)

(58) Field of Classification Search

CPC ..... H01F 27/29; H01F 27/292; H01F 5/02; H01F 5/04; H01F 3/10; H01F 17/04

USPC ..... 336/83, 192

See application file for complete search history.

(56) References Cited

U.S. PATENT DOCUMENTS

| | | | | |
|---|---|---|---|---|
| 3,663,914 | A * | 5/1972 | Lane | H01F 5/04 336/192 |
| 3,963,857 | A * | 6/1976 | Reynolds | H01F 5/04 174/84 C |
| 6,680,664 | B2 * | 1/2004 | Fan | H01F 17/045 29/602.1 |
| 7,471,179 | B2 * | 12/2008 | Hatakeyama | H01F 17/045 336/192 |
| 7,791,444 | B2 * | 9/2010 | Tomonari | H01F 19/04 336/192 |
| 7,920,041 | B2 * | 4/2011 | Rokuka | H01Q 1/1278 336/192 |
| 8,013,704 | B2 * | 9/2011 | Kitajima | H01F 17/045 336/83 |

(Continued)

*Primary Examiner* — Alexander Talpalatski
*Assistant Examiner* — Joselito S. Baisa
(74) *Attorney, Agent, or Firm* — Litron Patent & Trademark Office; Min-Lee Teng

(57) ABSTRACT

An electronic component comprising: a body; a conductive wire in the body; and a first lead comprising a first part disposed on a first surface of the body and a second part disposed on a second surface of the body, wherein the second part of the first lead comprises a first protrusion portion and a second protrusion portion spaced apart from each other, wherein a first portion of a first terminal part of the conductive wire is disposed between the first protrusion portion and the second part of the first lead disposed on the second surface of the body, and a second portion of the first terminal part of the conductive wire is disposed between the second protrusion portion and the second part of the first lead disposed on the second surface of the body.

18 Claims, 6 Drawing Sheets

(56) References Cited

U.S. PATENT DOCUMENTS

| | | | | |
|---|---|---|---|---|
| 9,202,620 | B2 * | 12/2015 | Arimitsu | H01F 17/045 |
| 9,305,695 | B2 * | 4/2016 | Karasek | H01F 17/045 |
| 9,905,355 | B2 * | 2/2018 | Takagi | H01F 27/266 |
| 9,978,506 | B2 * | 5/2018 | Ohtsubo | H01F 27/255 |
| 10,786,932 | B2 * | 9/2020 | Takahashi | B22F 1/0059 |
| 2002/0190830 | A1 * | 12/2002 | Matsumoto | H01F 21/08 336/83 |
| 2009/0195341 | A1 * | 8/2009 | Rokuka | H01Q 1/1278 336/65 |
| 2010/0194517 | A1 * | 8/2010 | Karasek | H01F 27/02 336/221 |
| 2011/0260821 | A1 * | 10/2011 | Yamada | H01F 41/10 336/192 |
| 2011/0279211 | A1 * | 11/2011 | Miura | H01F 41/10 29/605 |
| 2013/0113585 | A1 * | 5/2013 | Oki | H01F 27/29 335/297 |
| 2013/0154780 | A1 * | 6/2013 | Yamada | H01F 17/043 336/175 |
| 2014/0002227 | A1 * | 1/2014 | Hsieh | H01F 41/10 336/200 |
| 2014/0070914 | A1 * | 3/2014 | Oki | H01F 41/0206 336/233 |
| 2015/0027770 | A1 * | 1/2015 | Chou | H01L 23/495 174/266 |
| 2015/0042436 | A1 * | 2/2015 | Arimitsu | H01F 17/045 336/192 |
| 2016/0075058 | A1 * | 3/2016 | Takahashi | H01F 27/292 264/272.13 |
| 2016/0217919 | A1 * | 7/2016 | Iwata | H01F 27/29 |
| 2016/0225521 | A1 * | 8/2016 | Yamada | H01F 41/0246 |
| 2018/0261365 | A1 * | 9/2018 | Igarashi | H01F 27/38 |
| 2018/0261380 | A1 * | 9/2018 | Igarashi | H01F 17/045 |

* cited by examiner

STRUCTURE OF AN ELECTRONIC COMPONENT AND AN INDUCTOR

CROSS-REFERENCES TO RELATED APPLICATIONS

This application is a continuation of U.S. patent application Ser. No. 14/867,019, filed on Sep. 28, 2015, which claims the benefit of U.S. Provisional Patent Application No. 62/194,308 filed on Jul. 20, 2015, which is hereby incorporated by reference herein and made a part of specification.

BACKGROUND OF THE INVENTION

1. Field of the Invention

The present invention relates to an electronic component with leads, and more particularly, to an inductor with leads on multiple surfaces thereof.

2. Description of the Prior Art

Inductors are commonly used in the electronics industry for storing magnetic energy. An inductor is typically created by providing an electric current through a metal conductor, such as a metal plate or bar. The current passing through the metal conductor creates a magnetic field or flux around the conductor.

Some electronic devices having inductor components may be used in mechanical applications such as heavy machineries or vehicles. These heavy machineries or vehicles may go through a lot of strain when being used. In the case of vehicles, when being driven, the car may go through uneven terrain and cause the whole car to shake. At present, when manufacturing an inductor such as a surface mount inductor, the leads used to weld the inductor onto the corresponding electronic devices only use adhesives to fix the leads onto the inductor body. When the inductor experiences shaking or vibration, the adhesive used to fix the leads onto the inductor body may loosen and cause the leads to be removed from the inductor body. Thus, there is a need to develop a method of manufacturing an inductor that is durable for mechanical applications

SUMMARY OF THE INVENTION

An embodiment of the present invention presents an electronic component. The electronic component comprises a body, a conductive element disposed in the body, and a first lead disposed on the body. A first part of the first lead is disposed on a first surface of the body. A second part of the first lead is disposed on a second surface of the body. And, a third part of the first lead is disposed on a third surface of the body. The first surface, the second surface and the third surface of the body are not coplanar with each other. And, the first lead is electrically connected to the conductive element.

In one embodiment, the first part of the first lead is disposed on a bottom surface of the body, the second part of the first lead is disposed on a first lateral surface of the body and the third part of the first lead is disposed on a recess of a second lateral surface of the body.

In one embodiment, the electronic component further comprises a second lead, wherein a first part of the second lead is disposed on the first surface of the body, a second part of the second lead is disposed on a fourth surface of the body opposite to the second surface and a third part of the second lead is disposed on a fifth surface of the body, wherein the first surface, the fourth surface and the fifth surface of the body are not coplanar with each other, wherein the second lead is electrically connected to the conductive element. In one embodiment, the electronic component is an inductor, wherein the body is a magnetic body, wherein, wherein the magnetic body comprises a first core and the conductive element is a conductive wire wound on a winding shaft of the first core, wherein each of the parts of the lead is adhesively fixed on the surfaces of the first core, respectively.

In one embodiment, the first core is an H-core having a winding shaft, a first flange section, and a second flange section and the second core is an I-core, wherein the conductive wire is wound on the winding shaft of the H-core.

In one embodiment, the electronic component further comprises a second core disposed on the first core.

In one embodiment, the first lead further comprises a fourth part disposed on a sixth surface of the body, wherein the first surface, the second surface, the third surface and the sixth surface of the body are not coplanar with each other.

In one embodiment, the second part of the first lead has a protrusion protruding in a direction away from the body, wherein a first end of the conductive wire is disposed between the protrusion of the second part of the first lead and the second part of the first lead disposed on the second surface of the body and is electrically connected to the first lead.

Another embodiment of the present invention presents an inductor. The inductor comprises a magnetic body, a conductive wire disposed in the magnetic body, and a first lead disposed on the magnetic body. A first part of the first lead is disposed on a first surface of the body. A second part of the first lead is disposed on a second surface of the body. And, a third part of the first lead is disposed on a third surface of the body. The first surface, the second surface and the third surface of the body are not coplanar with each other. And, the first lead is electrically connected to the conductive element.

In one embodiment, the inductor further comprising a second lead, wherein a first part of the second lead is disposed on the first surface of the first core, a second part of the second lead is disposed on a fourth surface of the first core opposite to the second surface and a third part of the second lead is disposed on a fifth surface of the first core, wherein the first surface, the fourth surface and the fifth surface of the body are not coplanar with each other, wherein the first lead and the second lead are respectively electrically connected to a first end and a second end of the conductive wire.

In one embodiment, the first lead of the inductor further comprises a fourth part disposed on a sixth surface of the body, wherein the first surface, the second surface, the third surface and the sixth surface of the body are not coplanar with each other.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
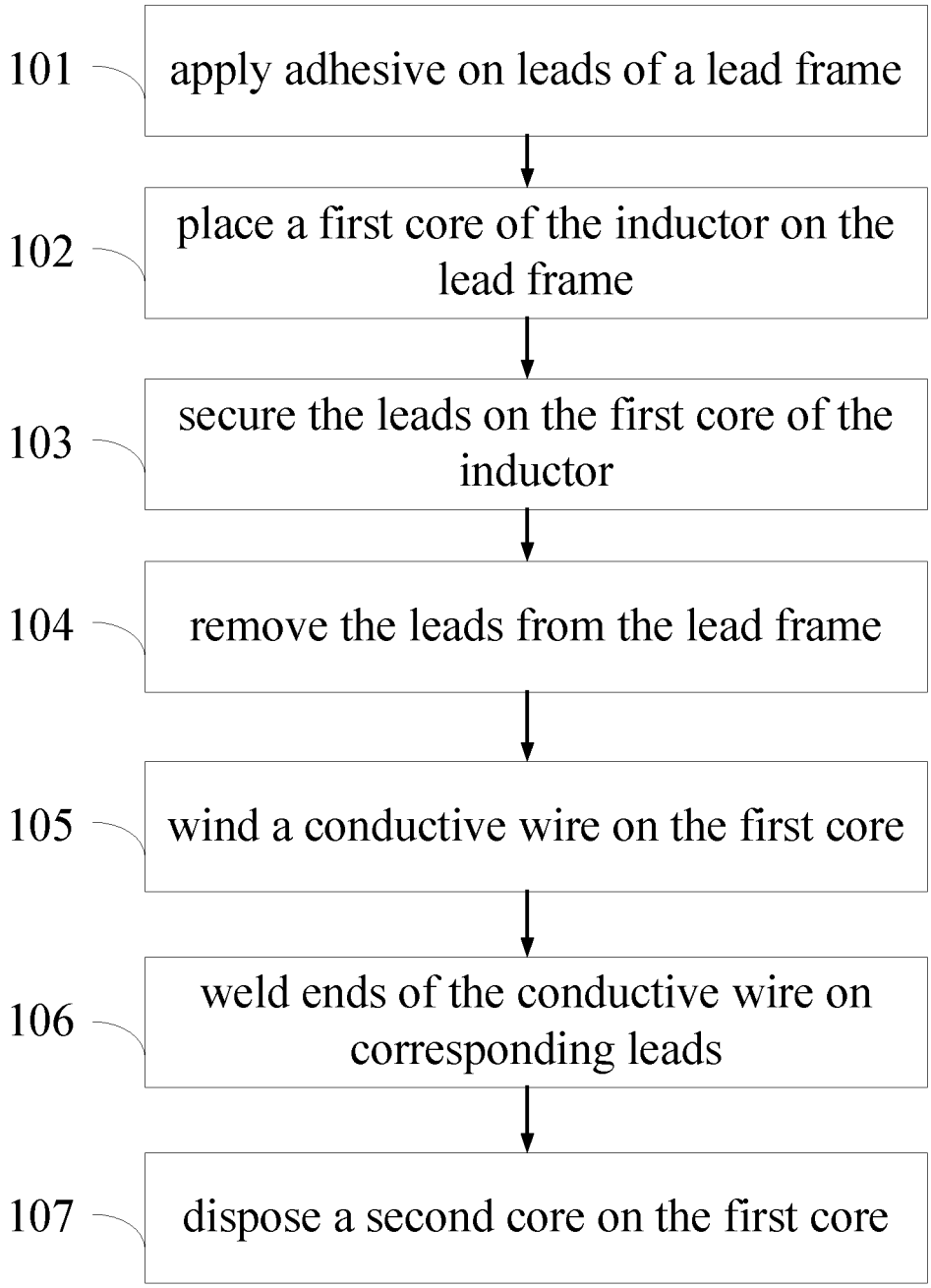
FIG. 1 illustrates a flowchart of a method of forming an inductor according to an embodiment of the present invention.

FIG. 1 illustrates a flowchart of a method of forming an inductor according to an embodiment of the present invention. The method may comprise, but is not limited to, the following steps:

Step 101: applying adhesive on leads of a lead frame;

Step 102: placing a first core of the inductor on the lead frame;

Step 103: securing the leads on the first core of the inductor;

Step 104: removing the leads from the lead frame;

Step 105: winding a conductive wire on the first core;

Step 106: welding ends of the conductive wire on corresponding leads;

Step 107: disposing a second core on the first core.

Figure 2:
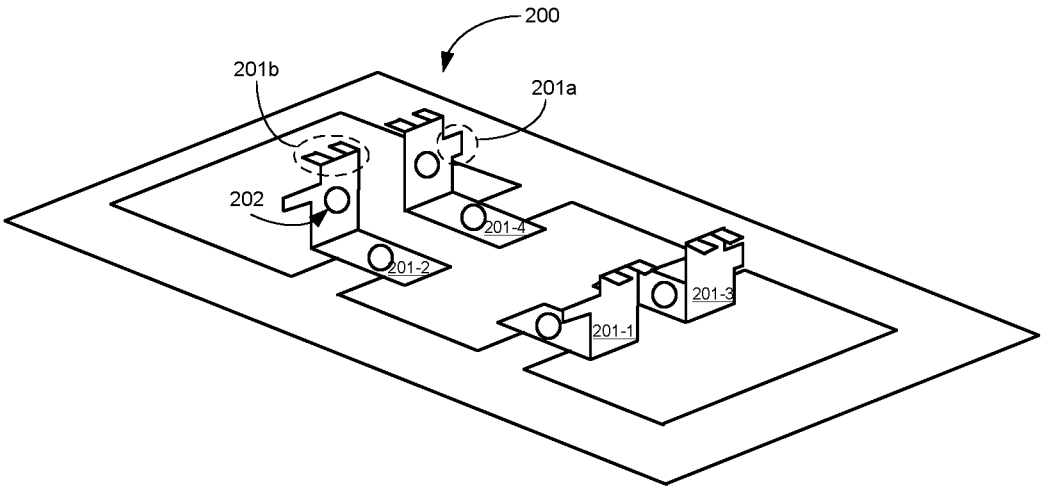
FIG. 2 illustrates a lead frame 200 according to an embodiment of the present invention.

In step 101, adhesives may be applied on the leads of the lead frame. The lead frame may have at least two leads. FIG. 2 illustrates a lead frame 200 according to an embodiment of the present invention. The lead frame 200 may comprise of four leads 201-1, 201-2, 201-3, and 201-4. Each of the leads 201-1, 201-2, 201-3, and 201-4 may have a protrusion 201*a* used for securing the leads 201-1, 201-2, 201-3, and 201-4 to the first core. Each of the leads 201-1, 201-2, 201-3, and 201-4 may also have a protrusion 201*b* used for securing the conductive wire. Adhesives 202 may be may be strategically placed on points of the leads 201-1, 201-2, 201-3, and 201-4.

Figure 3:
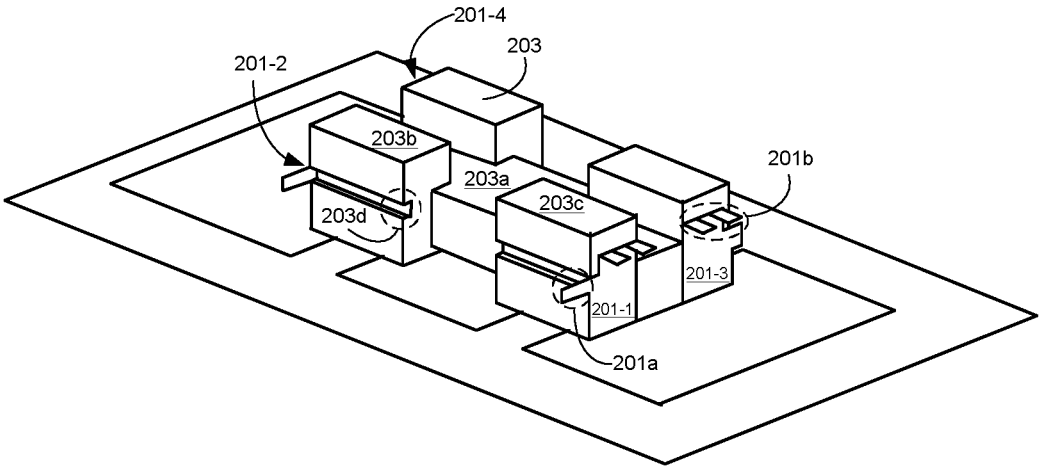
FIG. 3 illustrates an exemplary embodiment of step 102 in FIG. 1.

In step 102, the first core of the inductor may be placed on the lead frame. FIG. 3 illustrates an exemplary embodiment of step 102 in FIG. 1. In the exemplary embodiment, the first core 203 may be placed on the lead frame 200 shown in FIG. 2. The first core in the exemplary embodiment may be an H-core. The first core 203 may have a winding shaft 203*a*, first flange section 203*b* and a second flange section 203*c*. The first flange section 203*b* and the second flange section 203*c* may be formed respectively at ends of the winding shaft 203*a*. The first flange section 203*b* and the second flange section 203*c* may have the same peripheral area. The first core 203 may be first aligned to the leads 201-1, 201-2, 201-3, and 201-4 of the lead frame 200 before placement. The adhesives 202 placed on the leads 201-1, 201-2, 201-3, and 201-4 may be used to adhesively fix the first core 203 and the leads to each other. In the exemplary embodiment of FIG. 3, two of the four leads 201-1, 201-2, 201-3, and 201-4 may be adhesively fixed to the first flange section 203*b* and another two of the four leads 201-1, 201-2, 201-3, and 201-4 may be adhesively fixed the second flange section 203*c*.

Figure 4:
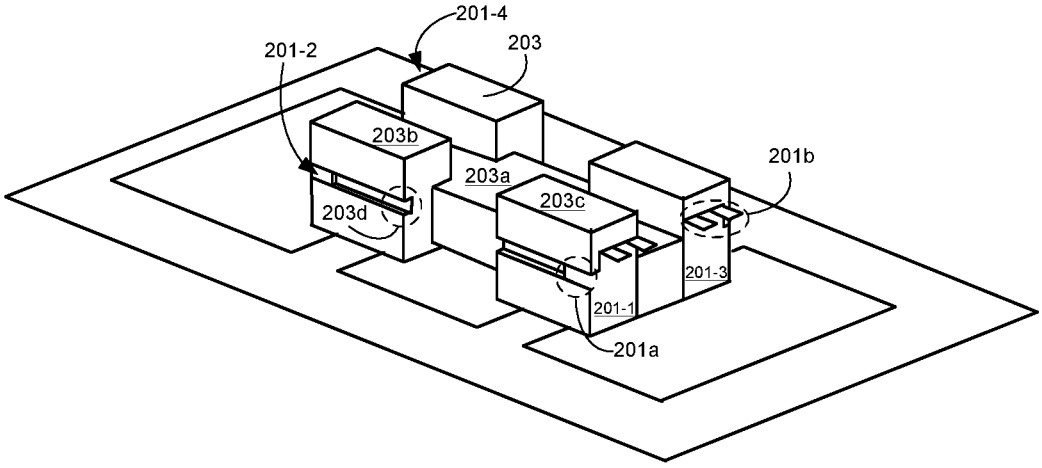
FIG. 4 illustrates an exemplary embodiment of step 103 in FIG. 1.

In step 103, the leads may be secured onto the first core. FIG. 4 illustrates an exemplary embodiment of step 103 in FIG. 1. To secure the leads 201-1, 201-2, 201-3, and 201-4 to the first core 203, the protrusion 201*a* may be embedded into a recess 203*d* of the first core 203. As shown in FIG. 4, the first flange section 203*b* and the second flange section 203*c* may each have at least two recesses 203*d*. Each of the four leads 201-1, 201-2, 201-3, and 201-4 of the exemplary embodiment may have a corresponding recess 203*d* for securing the leads 201-1, 201-2, 201-3, and 201-4 to the first core 203. By securing the leads 201-1, 201-2, 201-3, and 201-4 to the first core 203, damages, such as the leads 201-1, 201-2, 201-3, and 201-4 detaching from the first core 203, that may occur when the inductor is vigorously shaken may be prevented.

Figure 5:
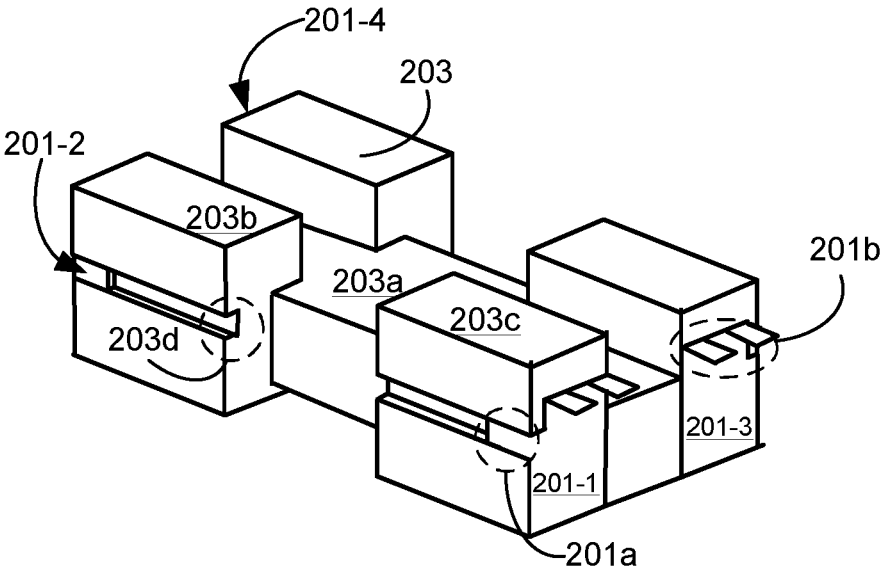
FIG. 5 illustrates an exemplary embodiment of step 104 in FIG. 1.
Figure 6:
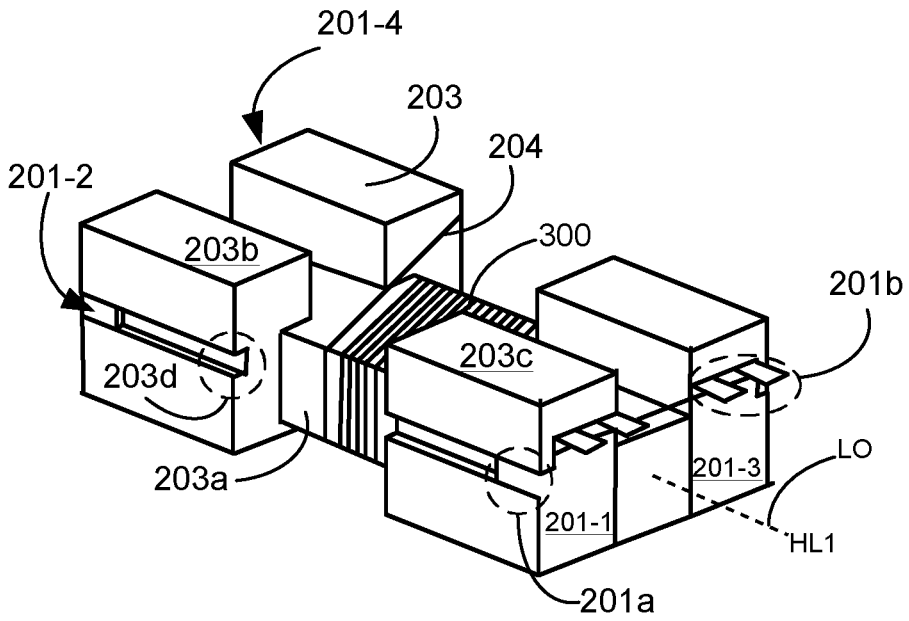
FIG. 6 illustrates an exemplary embodiment of step 105 in FIG. 1.

In step 104, the leads may be removed from the lead frame. FIG. 5 illustrates an exemplary embodiment of step 104 in FIG. 1. In step 105, the conductive wire may be wound around the first core. FIG. 6 illustrates an exemplary embodiment of step 105 in FIG. 1. The conductive wire 204 may be any type of conductive metal. The diameter of the conductive wire may vary according to the size and application of the inductor. The conductive wire 204 may be wound around the winding shaft 203*a* of first core 203 for N number of times. The inductance of the inductor may be determined partially according to the number of times the conductive wire 204 is wound around the first core 203. A first end of the conductive wire 204 may be placed onto the first flange section 203*b* of the first core 203 to start the winding of the conductive wire 204 and a second end of the conductive wire 204 may be placed onto the second flange section 203*c* of the first core 203 after being wound N times around the winding shaft 203*a* of first core 203. As shown in FIG. 6, the conductive wire 204 comprises a coil 300 wound around a horizontal line HL1 with a first part LO of the horizontal line HL1 being located outside of the body.

Figure 7:
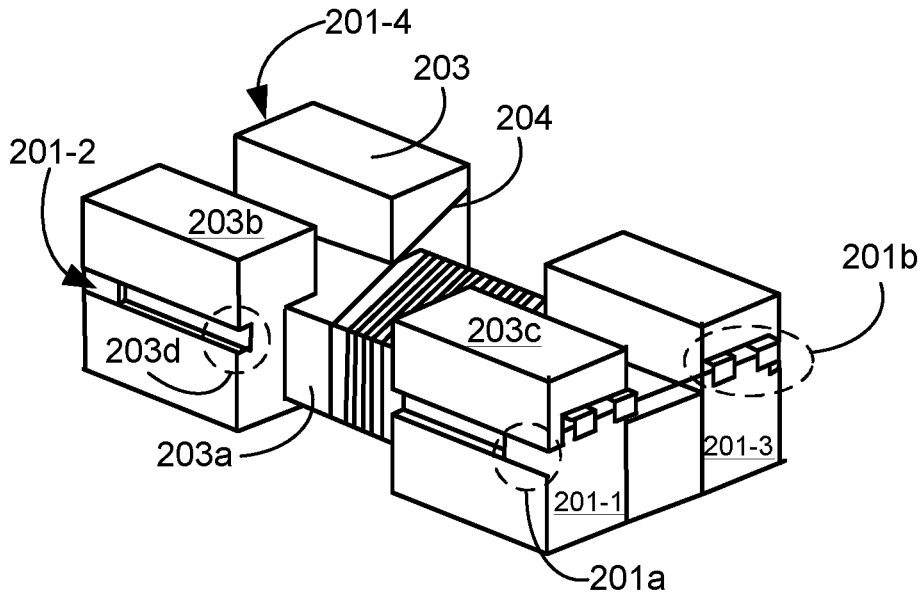
FIG. 7 illustrates an exemplary embodiment of step 106 in FIG. 1.

In step 106, ends of the conductive wire may be welded on corresponding leads 201-1, 201-2, 201-3, and 201-4. FIG. 7 illustrates an exemplary embodiment of step 106 in FIG. 1. Ends of the conductive wire 204 may be welded to respective the leads 201-1, 201-2, 201-3, and 201-4 using a filler metal having a lower melting point that the conductive 204 wire and the metal used to form the leads 201-1, 201-2, 201-3, and 201-4. In some other embodiments, the protrusion 201*b* of a lead 201-1, 201-2, 201-3, or 201-4 may be bent to secure the conductive wire 204 in place on the lead 201-1, 201-2, 201-3, or 201-4. In this way, an end of the conductive wire 204 may be pinched in place between at least two parts of the lead 201-1, 201-2, 201-3, or 201-4. In some other embodiment of the present invention, a first end of the conductive wire 204 is welded onto the first lead 201-1 and a second end of the conductive wire 204 is welded onto the second lead 201-2. The third lead 201-3 and the fourth lead 201-4 may be dummy leads wherein the ends of the conductive wire 204 are not welded onto the third lead 201-3 and the fourth lead 201-4. The third lead 201-3 and the fourth lead 201-4 may not be electrically connected to the conductive wire.

Figure 8:
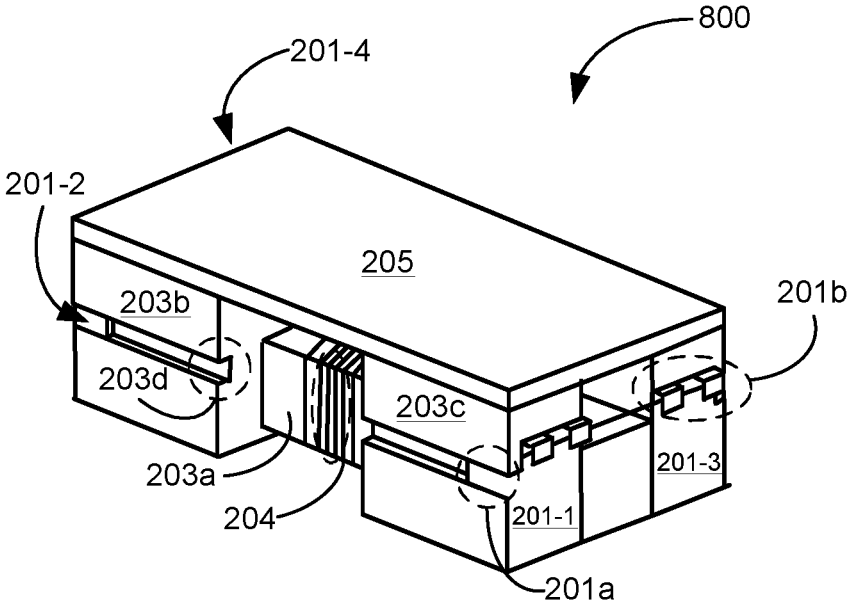
FIG. 8 illustrates an inductor 800 according to a first embodiment of the present invention.

In step 107, the second core may be disposed onto the first core. FIG. 8 illustrates an inductor 800 according to a first embodiment of the present invention. The second core 205 may be an I-core. The second core 205 may be aligned to the first core 203 and baked to fuse the second core 205 to the first core 203.

As a first exemplary embodiment of the present invention, the inductor 800 in FIG. 8 comprises of at least two leads 201-1, 201-2, 201-3, and 201-4, a first core 203, a conductive wire 204, and a second core 205. The first core 203 may comprise a winding shaft 203*a*, a first flange section 203*b* and a second flange section 203*c*. As an exemplary embodiment, two leads 201-1 and 201-3 may be fixed onto the first flange section 203*b* of the first core 203 and another two leads 201-2 and 201-4 may be fixed onto the second flange section 203*c* of the first core 203. A first lead 201 may be fixed onto the first flange section 203*b*, a first part of the first lead 201-1 may be adhesively fixed on a first lateral surface of the first flange section 203*b*, a second part of the first lead 201-1 may be adhesively fixed on a second lateral surface of the first flange section 203*b*, and a protrusion 201*a* on the second part of the first lead 201-1 may be embedded on a recess 203*d* of a third lateral surface of the first flange section 203*b* to mechanically fix the first lead 201-1 on the first core 203.

A second lead 201-2 may be fixed onto the second flange section 203*c*, a first part of the second lead 201-2 may be adhesively fixed on a first lateral surface of the second flange section 203*c*, a second part of the third lead 201 may be adhesively fixed on a second lateral surface of the first flange section 203*b*, and a protrusion 201*a* on the second part of the second lead 201-2 may be embedded on a recess 203*d* of a third lateral surface of the second flange section 203*c* to mechanically fix the second lead 201-2 on the first core 203. A third lead 201-3 may be fixed onto the first flange section 203*b*, a first part of the third lead 201-3 may be adhesively fixed on the first lateral surface of the first flange section 203*b*, a second part of the third lead 201-3 may be adhesively fixed on the second lateral surface of the first flange section 203*b*, and a protrusion 201*a* on the second part of the third lead 201-3 may be embedded on a recess 203*d* of a fourth lateral surface of the first flange section 203*b* to mechanically fix the third lead 201-3 on the first core 203. A fourth lead 201-4 may be fixed onto the second flange section 203*c*, a first part of the fourth lead 201-4 may be adhesively fixed on the first lateral surface of the first flange section 203*b*, a second part of the fourth lead 201-4 may be adhesively fixed on the second lateral surface of the second flange section 203*c*, and a protrusion 201*a* on the second part of the fourth lead 201-4 may be embedded on a recess 203*d* of a fourth lateral surface of the second flange section 203*c* to mechanically fix the fourth lead 201-4 on the first core 203. The conductive wire 204 may be wound around the winding shaft 203*a* of the first core N number of times. The ends of the conductive wire 204 may each be fixed onto a corresponding lead 201-1, 201-2, 201-3, or 201-4 by welding the end of the conductive wire 204 on the lead 201. Furthermore, a protrusion 201*b* on the second part of the lead 201-1, 201-2, 201-3, or 201-4 may be bent to pinch and secure in place the end of the conductive wire 204 between the protrusion 201*b* and the second part of the lead 201-1, 201-2, 201-3, or 201-4. The second core 205 may be fused to the first core 203 by using a baking process. In the exemplary embodiment, the second core 205 may be fused to a fifth lateral surface of the first flange section 203*b* of the first core 203 and a fifth lateral surface of the second flange section 203*c* of the first core 203.

Figure 9:
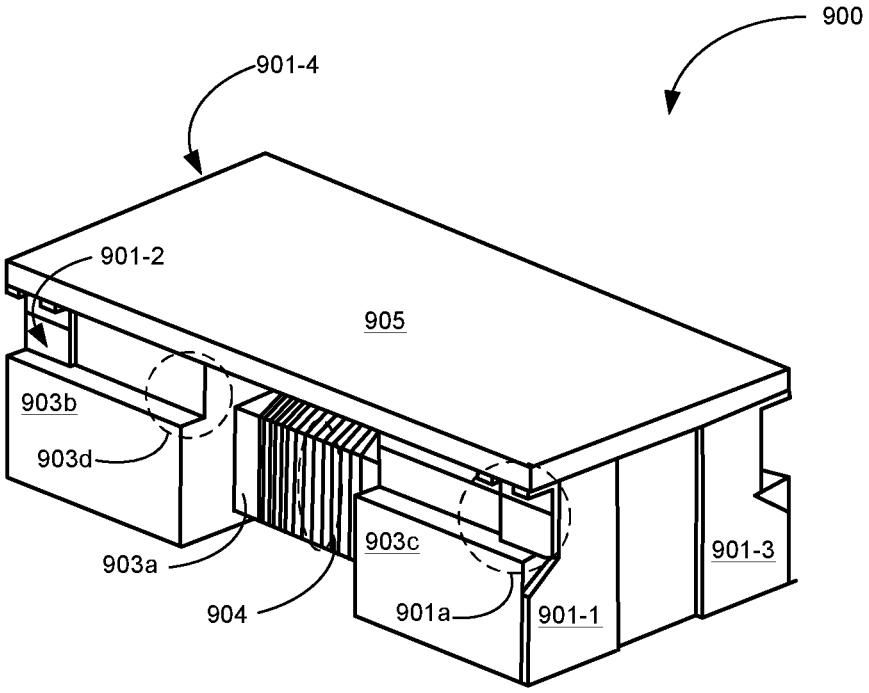
FIG. 9 illustrates an inductor 900 according to a second embodiment of the present invention.

FIG. 9 illustrates an inductor 900 according to a second embodiment of the present invention. The inductor 900 in FIG. 9 comprises of at least two leads 901-1, 901-2, 901-3, and 901-4, a first core 903, a conductive wire 904, and a second core 905. The first core 903 may comprise a winding shaft 903*a*, a first flange section 903*b* and a second flange section 903*c*. As an exemplary embodiment, two leads 901-1 and 901-3 may be fixed onto the first flange section 903*b* of the first core 903 and another two leads 901-2, and 901-4 may be fixed onto the second flange section 903*c* of the first core 903. A first lead 901 may be fixed onto the first flange section 903*b*, a first part of the first lead 901-1 may be adhesively fixed on a first lateral surface of the first flange section 903*b*, a second part of the first lead 901-1 may be adhesively fixed on a second lateral surface of the first flange section 903*b*, and a protrusion 901*a* on the second part of the first lead 901-1 may be embedded on a recess 903*d* of a third lateral surface of the first flange section 903*b* to mechanically fix the first lead 901-1 on the first core 903. A second lead 901-2 may be fixed onto the second flange section 903*c*, a first part of the second lead 901-2 may be adhesively fixed on a first lateral surface of the second flange section 903*c*, a second part of the second lead 901-2 may be adhesively fixed on a second lateral surface of the first flange section 903*b*, and a protrusion 901*a* on the second part of the second lead 901-2 may be embedded on a recess 903*d* of a third lateral surface of the second flange section 203*c* to mechanically fix the second lead 901-2 on the first core 903. A third lead 901-3 may be fixed onto the first flange section 903*b*, a first part of the third lead 901-3 may be adhesively fixed on the first lateral surface of the first flange section 903*b*, a second part of the third lead 901-3 may be adhesively fixed on the second lateral surface of the first flange section 903*b*, and a protrusion 901*a* on the second part of the third lead 901-3 may be embedded on a recess 903*d* of a fourth lateral surface of the first flange section 903*b* to mechanically fix the third lead 901-3 on the first core 903. A fourth lead 901-4 may be fixed onto the second flange section 903*c*, a first part of the fourth lead 901-4 may be adhesively fixed on the first lateral surface of the first flange section 903*b*, a second part of the fourth lead 901-4 may be adhesively fixed on the second lateral surface of the second flange section 903*c*, and a protrusion 901*a* on the second part of the fourth lead 901-4 may be embedded on a recess 903*d* of a fourth lateral surface of the second flange section 903*c* to mechanically fix the fourth lead 901 on the first core 903. The conductive wire 904 may be wound around the winding shaft 903*a* of the first core N number of times. The ends of the conductive wire 904 may each be fixed onto a corresponding lead 901-1, 901-2, 901-3, or 901-4 by welding the end of the conductive wire 904 on the corresponding lead 901-1, 901-2, 901-3, or 901-4. Furthermore, a second part of the protrusion 901*a* may be bent to pinch and secure in place the end of the conductive wire 904 between the second part of the protrusion 901*a* and a first part of the protrusion 901*a*. The second core 905 may be fused to the first core 903 by using a baking process. In the exemplary embodiment, the second core 905 may be fused to a fifth lateral surface of the first flange section 903*b* of the first core 903 and a fifth lateral surface of the second flange section 903*c* of the first core 903.

Figure 10:
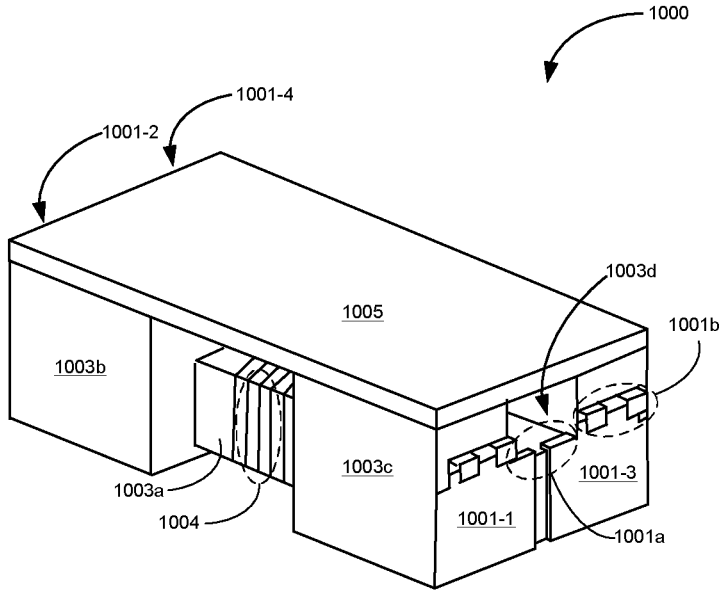
FIG. 10 illustrates an inductor according to a third embodiment of the present invention.

FIG. 10 illustrates an inductor according to a third embodiment of the present invention. The inductor 1000 in FIG. 10 comprises of at least two leads 1001-1, 1001-2, 1001-3, and 1001-4, a first core 1003, a conductive wire 1004, and a second core 1005. The first core 1003 may comprise a winding shaft 1003*a*, a first flange section 1003*b* and a second flange section 1003*c*. As an exemplary embodiment, two leads 1001-1 and 1001-3 may be fixed onto the first flange section 1003*b* of the first core 1003 and another two leads 1001-2 and 1001-4 may be fixed onto the second flange section 1003*c* of the first core 1003. A first lead 1001-1 may be fixed onto the first flange section 1003*b*, a first part of the first lead 1001-1 may be adhesively fixed on a first lateral surface of the first flange section 1003*b*, a second part of the first lead 1001-1 may be adhesively fixed on a second lateral surface of the first flange section 1003*b*, and a protrusion 1001*a* on the second part of the first lead 1001-1 may be embedded on a recess 1003*d* of a third lateral surface of the first flange section 1003*b* to mechanically fix the first lead 1001-1 on the first core 1003. A second lead 1001-2 may be fixed onto the second flange section 1003*c*, a first part of the second lead 1001-2 may be adhesively fixed on a first lateral surface of the second flange section 1003*c*, a second part of the second lead 1001-2 may be adhesively fixed on a second lateral surface of the first flange section 1003*b*, and a protrusion 1001*a* on the second part of the second lead 1001-2 may be embedded a recess 1003*d* of a third lateral surface of the second flange section 1003*c* to mechanically fix the second lead 1001-2 on the first core 1003. A third lead 1001-3 may be fixed onto the first flange section 1003*b*, a first part of the third lead 1001-3 may be adhesively fixed on the first lateral surface of the first flange section 1003*b*, a second part of the third lead 1001-3 may be adhesively fixed on the second lateral surface of the first flange section 1003*b*, and a protrusion 1001*a* on the second part of the third lead 1001-3 may also be embedded on the recess 1003*d* of the third lateral surface of the first flange section 1003*b* to mechanically fix the third lead 1001-3 on the first core 1003. A fourth lead 1001-4 may be fixed onto the second flange section 1003*c*, a first part of the fourth lead 1001-4 may be adhesively fixed on the first lateral surface of the first flange section 1003*b*, a second part of the fourth lead 1001-3 may be adhesively fixed on the second lateral surface of the second flange section 1003*c*, and a protrusion 1001*a* on the second part of the fourth lead 1001 may also be embedded on the recess 1003*d* of the third lateral surface of the second flange section 1003*c* to mechanically fix the fourth lead 1001 on the first core 1003. The conductive wire 1004 may be wound around the winding shaft 1003*a* of the first core N number of times. The ends of the conductive wire 1004 may each be fixed onto a corresponding lead 1001-1, 1001-2, 1001-3, or 1001-4 by welding the end of the conductive wire 1004 on the corresponding lead 1001-1, 1001-2, 1001-3, or 1001-4. Furthermore, a protrusion 1001*b* on the second part of the corresponding lead 1001-1, 1001-2, 1001-3, or 1001-4 may be bent to pinch and secure in place the end of the conductive wire 1004 between the protrusion 1001*b* and the second part of the corresponding lead 1001-1, 1001-2, 1001-3, or 1001-4. The second core 1005 may be fused to the first core 1003 by using a baking process. In the exemplary embodiment, the second core 1005 may be fused to third lateral surface of the first flange section 1003*b* of the first core 1003 and the third lateral surface of the second flange section 1003*c* of the first core 1003.

Figure 11:
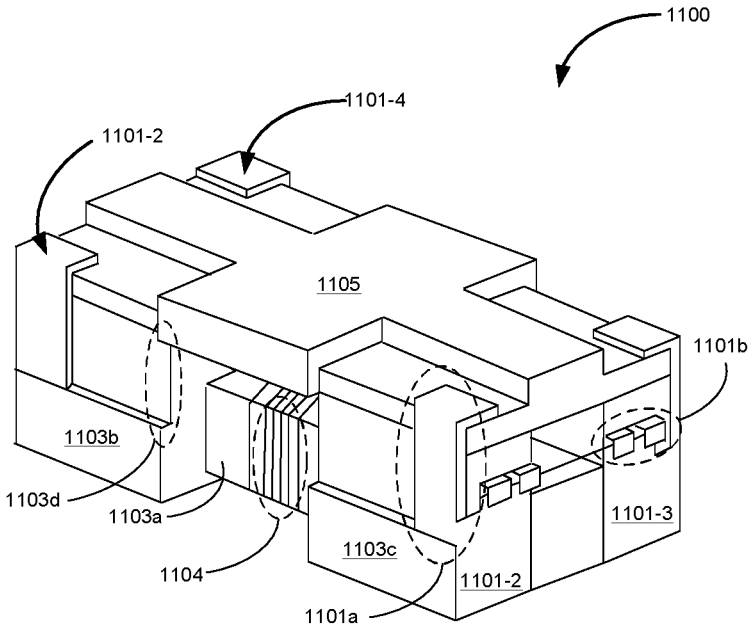
FIG. 11 illustrates an inductor according to a fourth embodiment of the present invention.

FIG. 11 illustrates an inductor according to a fourth embodiment of the present invention. The inductor 1100 in FIG. 11 comprises of at least two leads 1101-1, 1101-2, 1101-3, and 1101-4, a first core 1103, a conductive wire 1104, and a second core 1105. The first core 1103 may comprise a winding shaft 1103*a*, a first flange section 1103*b* and a second flange section 1103*c*. As an exemplary embodiment, two leads 1101-1 and 1101-3 may be fixed onto the first flange section 1103*b* of the first core 1103 and another two leads 1101-2 and 1101-4 may be fixed onto the second flange section 1103*c* of the first core 1103. A first lead 1101 may be fixed onto the first flange section 1103*b*, a first part of the first lead 1101-1 may be adhesively fixed on a first lateral surface of the first flange section 1103*b*, a second part of the first lead 1101-1 may be adhesively fixed on a second lateral surface of the first flange section 1103*b*, and a protrusion 1101*a* on the second part of the first lead 1101-1 may be embedded on a recess 1103*d* of a third lateral surface of the first flange section 1103*b* to mechanically fix the first lead 1101-1 on the first core 1103. A second lead 1101-2 may be fixed onto the second flange section 1103*c*, a first part of the second lead 1101-2 may be adhesively fixed on a first lateral surface of the second flange section 1103*c*, a second part of the second lead 1101-2 may be adhesively fixed on a second lateral surface of the first flange section 1103*b*, and a protrusion 1101*a* on the second part of the second lead 1101-2 may be embedded on a recess 1103*d* of a third lateral surface of the second flange section 1103*c* to mechanically fix the second lead 1101-2 on the first core 1103. A third lead 1101-3 may be fixed onto the first flange section 1103*b*, a first part of the third lead 1101-3 may be adhesively fixed on the first lateral surface of the first flange section 1103*b*, a second part of the third lead 1101-3 may be adhesively fixed on the second lateral surface of the first flange section 1103*b*, and a protrusion 1101*a* on the second part of the third lead 1101-3 may be embedded on a recess 1103*d* of a fourth lateral surface of the first flange section 1103*b* to mechanically fix the third lead 1101-3 on the first core 1103. A fourth lead 1101-4 may be fixed onto the second flange section 1103*c*, a first part of the fourth lead 1101-4 may be adhesively fixed on the first lateral surface of the first flange section 1103*b*, a second part of the fourth lead 1101-4 may be adhesively fixed on the second lateral surface of the second flange section 1103*c*, and a protrusion 1101*a* on the second part of the fourth lead 1101-4 may be embedded on a recess 1103*d* of a fourth lateral surface of the second flange section 1103*c* to mechanically fix the fourth lead 1101-4 on the first core 203. The conductive wire 1104 may be wound around the winding shaft 1103*a* of the first core N number of times. The ends of the conductive wire 1104 may each be fixed onto a corresponding lead 1101-1, 1101-2, 1101-3, or 1101-4 by welding the end of the conductive wire 1104 on the corresponding lead 1101-1, 1101-2, 1101-3, or 1101-4. Furthermore, a protrusion 1101*b* on the second part of the lead 1101-1, 1101-2, 1101-3, or 1101-4 may be bent to pinch and secure in place the end of the conductive wire 1104 between the protrusion 1101*b* and the second part of the lead 1101-1, 1101-2, 1101-3, or 1101-4. The second core 1105 may be fused to the first core 1103 by using a baking process. In the exemplary embodiment, the second core 1105 may be fused to a fifth lateral surface of the first flange section 1103*b* of the first core 1103 and a fifth lateral surface of the second flange section 1103*c* of the first core 1103. To further stabilize the inductor 1100, the second core 1105 may have a recess at four corners of the second core 1105. After the second core 1105 has been fused to the first core 1103, a part of the protrusion 1101*a* of each of the leads 1101-1, 1101-2, 1101-3, and 1101-4 may be embedded onto a corresponding recess of the second core 1105.

Please note that the lead structure for the inductor can be applied to other electronic components as well for strengthening the mechanical strength between the leads and the body of the electronic component.

The present invention discloses a method of forming an inductor and a structure thereof. The first core and the second core of the inductor may be formed using magnetic material. Although the exemplary embodiments of the present invention have an H-core for the first core and an I-core for the second core, the present invention may have a combination of different type of first core and second core. The inductor may comprise of at least two leads used to couple the inductor to other electronic components as needed to form a working circuit. Each of the leads may comprise of at least one protrusion used to secure the leads onto a first core of the inductor. In some other embodiments of the present invention, each of the leads may comprise of at least two protrusions. The first protrusion is used to secure the leads onto a first core of the inductor. In some embodiments of the present invention, each of the leads may have the first protrusion configured to be embedded on the first core to mechanically fix the lead to the first core. In some other embodiment, each of the leads may be further embedded on the second core to mechanically fix the lead to the second core. In further embodiments of the present invention, each of the leads may have two first protrusions configured to be embedded on the first core to mechanically fix the lead to the first core. The second protrusion is used to secure an end of the conductive wire of the inductor onto the corresponding lead. The ends of the conductive wire are secured by pinching the ends of the conductive wire between a part of the respective lead and the second protrusion of the respective lead. In further embodiments of the present invention, the end of the conductive wire is secured by pinching the end of the conductive wire between a first part of the first protrusion and a second part of the first protrusion. Thus, the inductor of the present invention has at least one protrusion used to mechanically fix the leads onto the body of the inductor. By mechanically fixing the leads onto the body of the inductor, the inductor would now be able to better endure vibration or shaking from mechanical applications.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic component, comprising:

a body, comprising a top surface, a bottom surface and a first lateral surface connecting the top surface and the bottom surface;

a conductive wire, comprising a coil disposed in the body, wherein the coil is wound around a horizontal line, wherein the horizontal line passes through the body with a first part of the horizontal line being located outside of the body; and a first lead comprising a first part and a second part connected to the first part, wherein the first part of the first lead is disposed on the bottom surface of the body, and the second part of the first lead is disposed on the first lateral surface of the body, wherein the second part of the first lead comprises a first protrusion portion and a second protrusion portion spaced apart from the first protrusion portion, wherein each of the first protrusion portion and the second protrusion portion is located below the top surface of the body and protrudes in a direction away from the body, wherein the second part of the first lead disposed on the first lateral surface of the body comprises a top and contiguous portion, wherein the first protrusion portion is extended from a first portion of said top and contiguous portion of the second part of the first lead disposed on the first lateral surface of the body, and the second protrusion portion is extended from a second portion of said top and contiguous portion of the second part of the first lead disposed on the first lateral surface of the body, wherein a third portion of said top and contiguous portion that is disposed on the first lateral surface of the body and located between said first portion and said second portion of said top and contiguous portion extends downwardly to a bottom portion of said second part of the first lead via a corresponding portion of the second part of the first lead disposed on the first lateral surface of the body with at least one portion of the first protrusion portion located outside of the body, at least one portion of the second protrusion portion located outside of the body, and said first part of the horizontal line located outside of the body being located at a same lateral side of the body, said bottom portion of said second part of the first lead being bending from said first part of the first lead disposed on the bottom surface of the body, wherein a first portion of a first terminal part of the conductive wire is disposed between the first protrusion portion and the second part of the first lead disposed on the first lateral surface of the body, and a second portion of the first terminal part of the conductive wire is disposed between the second protrusion portion and the second part of the first lead disposed on the first lateral surface of the body, wherein the first terminal part of the conductive wire is electrically connected to the first lead.

2. The electronic component of claim 1, wherein the second part of the first lead further comprises a first bending portion bending downwardly from the first protrusion portion, wherein the first portion of the first terminal part of the conductive wire is disposed in a first space formed by the first protrusion portion, the first bending portion and the second part of the first lead disposed on the first lateral surface of the body.

3. The electronic component of claim 2, wherein the second part of the first lead further comprises a second bending portion bending downwardly from the second protrusion portion, wherein the second portion of the first terminal part of the conductive wire is disposed in a second space formed by the second protrusion portion, the second bending portion and the second part of the first lead disposed on the first lateral surface of the body.

4. The electronic component of claim 1, wherein each of the first part and the second part of the first lead is adhered to a corresponding surface of the body by applying an adhesive on the first lead.

5. The electronic component of claim 1, wherein the first portion of the first terminal part of the conductive wire is soldered to the first protrusion portion and the second portion of the first terminal part of the conductive wire is soldered to the second protrusion portion.

6. The electronic component of claim 1, further comprises a second lead comprising a first part and a second part connected to the first part of the second lead, wherein the first part of the second lead is disposed on the bottom surface of the body, and the second part of the second lead is disposed on a second lateral surface of the body, wherein the second lead comprises a third protrusion portion and a fourth protrusion portion spaced apart from the third protrusion portion, each of the third protrusion portion and the fourth protrusion portion protruding in a direction away from the body, wherein a first portion of a second terminal part of the conductive wire is disposed between the third protrusion portion and the second part of the second lead disposed on the second lateral surface of the body, and a second portion of the second terminal part of the conductive wire is disposed between the fourth protrusion portion and the second part of the second lead disposed on the second lateral surface of the body, wherein the second terminal part of the conductive wire is electrically connected to the second lead.

7. The electronic component of claim 6, wherein the second part of the second lead further comprises a third bending portion bending downwardly from the third protrusion portion, wherein the first portion of the second terminal part of the conductive wire is disposed in a third space formed by the third protrusion portion, the third bending portion and the second part of the second lead disposed on the second lateral surface of the body.

8. The electronic component of claim 7, wherein the second part of the first lead further comprises a fourth bending portion bending downwardly from the fourth protrusion portion, wherein the second portion of the first terminal part of the conductive wire is disposed in a fourth space formed by the fourth protrusion, the fourth bending portion and the second part of the second lead disposed on the second lateral surface of the body.

9. The electronic component of claim 8, wherein each of the first part and the second part of the second lead is adhered to a corresponding surface of the body by applying an adhesive on the second lead.

10. The electronic component of claim 6, further comprising a third lead, wherein the bottom surface of the body is disposed on a first part of the third lead, a second part of the third lead is disposed on a third lateral surface of the body, wherein the second part of the third lead has a fifth protrusion portion and a sixth protrusion portion spaced apart from the fifth protrusion portion, each of the fifth protrusion portion and the sixth protrusion portion being protruded away from the body.

11. The electronic component of claim 10, further comprising a fourth lead, wherein the bottom surface of the body is disposed on a first part of the fourth lead, a second part of the fourth lead is disposed on a fourth lateral surface of the body, wherein the second part of the fourth lead has a seventh protrusion portion and an eighth protrusion portion spaced apart from the seventh protrusion portion, each of the seventh protrusion portion and the eighth protrusion portion being protruded away from the body.

12. The electronic component of claim 1, wherein the body is a magnetic body, wherein the magnetic body comprises a first core and a second core disposed on the first core, wherein each of the parts of the first lead is adhesively fixed on the surfaces of the first core.

13. The electronic component of claim 12, wherein the first core is an H-core having a winding shaft, wherein the second core is an I-core, wherein the conductive wire is wound on the winding shaft of the H-core.

14. An inductive component, comprising: a magnetic body comprising a top surface, a bottom surface and a first lateral surface connecting the top surface and the bottom surface; a conductive wire, comprising a coil disposed in the magnetic body, wherein the coil is wound around a horizontal line, wherein the horizontal line passes through the magnetic body with a first part of the horizontal line being located outside of the magnetic body; and a first lead comprising a first part and a second part connected to the first part, wherein the first part of the first lead is disposed on the bottom surface of the magnetic body, and the second part of the first lead is disposed on the first lateral surface of the magnetic body, wherein the second part of the first lead comprises a first protrusion portion and a second protrusion portion spaced apart from the first protrusion portion, wherein each of the first protrusion portion and the second protrusion portion is located below the top surface of the magnetic body and protrudes in a direction away from the magnetic body, wherein the second part of the first lead disposed on the first lateral surface of the magnetic body comprises a top and contiguous portion, wherein the first protrusion portion is extended from a first portion of said top and contiguous portion of the second part of the first lead disposed on the first lateral surface of the magnetic body, and the second protrusion portion is extended from a second portion of said top and contiguous portion of the second part of the first lead disposed on the first lateral surface of the magnetic body, wherein a third portion of said top and contiguous portion that is disposed on the first lateral surface of the magnetic body and located between said first portion and said second portion of said top and contiguous portion extends downwardly to a bottom portion of said second part of the first lead via a corresponding portion of the second part of the first lead disposed on the first lateral surface of the magnetic body with at least one portion of the first protrusion portion located outside of the magnetic body, at least one portion of the second protrusion portion located outside of the magnetic body, and said first part of the horizontal line located outside of the magnetic body being located at a same lateral side of the magnetic body, said bottom portion of said second part of the first lead being bending from said first part of the first lead disposed on the bottom surface of the magnetic body, wherein a first portion of a first terminal part of the conductive wire is disposed between the first protrusion portion and the second part of the first lead disposed on the first lateral surface of the magnetic body, and a second portion of the first terminal part of the conductive wire is disposed between the second protrusion portion and the second part of the first lead disposed on the first lateral surface of the magnetic body, wherein the first terminal part of the conductive wire is electrically connected to the first lead.

15. The inductive component of claim 14, wherein the second part of the first lead further comprises a first bending portion bending downwardly from the first protrusion portion, wherein the first portion of the first terminal part of the conductive wire is disposed in a first space formed by the first protrusion portion, the first bending portion and the second part of the first lead disposed on the first lateral surface of the magnetic body.

16. The inductive component of claim 15, wherein the second part of the first lead further comprises a second bending portion bending downwardly from the second protrusion portion, wherein the second portion of the first terminal part of the conductive wire is disposed in a second space formed by the second protrusion portion, the second bending portion and the second part of the first lead disposed on the first lateral surface of the magnetic body.

17. The inductive component of claim 14, wherein each of the first part and the first portion of the second part of the first lead is adhered to a corresponding surface of the magnetic body by applying an adhesive on the first lead.

18. The inductive component of claim 14, further comprises a second lead comprising a first part and a second part connected to the first part of the second lead, wherein the first part of the second lead is disposed on the bottom surface of the magnetic body, and the second part of the second lead is disposed on a second lateral surface of the magnetic body, wherein the second lead comprises a third protrusion portion and a fourth protrusion portion spaced apart from the third protrusion portion, each of the third protrusion portion and the fourth protrusion portion protruding in a direction away from the magnetic body, wherein a first portion of a second terminal part of the conductive wire is disposed between the third protrusion portion and the second part of the second lead disposed on the second lateral surface of the magnetic body, and a second portion of the second terminal part of the conductive wire is disposed between the fourth protrusion portion and the second part of the second lead disposed on the second lateral surface of the magnetic body, wherein the second terminal part of the conductive wire is electrically connected to the second lead.

* * * * *